US008670011B2

(12) United States Patent
Mizutani et al.

(10) Patent No.: US 8,670,011 B2
(45) Date of Patent: Mar. 11, 2014

(54) ERASING APPARATUS AND IMAGE ERASING METHOD

(75) Inventors: Kikuo Mizutani, Shizuoka-ken (JP); Isao Yahata, Shizuoka-ken (JP); Takahiro Kawaguchi, Shizuoka-ken (JP); Yoshiaki Sugizaki, Shizuoka-ken (JP); Ken Iguchi, Shizuoka-ken (JP); Hiroyuki Taki, Shizuoka-ken (JP); Hiroyuki Tsuchihashi, Shizuoka-ken (JP); Chiaki Iizuka, Shizuoka-ken (JP); Hidetoshi Yokochi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 91 days.

(21) Appl. No.: 13/484,187

(22) Filed: May 30, 2012

(65) Prior Publication Data

US 2012/0306983 A1 Dec. 6, 2012

Related U.S. Application Data

(60) Provisional application No. 61/493,379, filed on Jun. 3, 2011, provisional application No. 61/493,386, filed on Jun. 3, 2011, provisional application No. 61/493,387, filed on Jun. 3, 2011.

(51) Int. Cl.
*B41J 29/16* (2006.01)

(52) U.S. Cl.
USPC ..... 347/179

(58) Field of Classification Search
USPC ..... 347/171, 179, 218, 222, 101, 104
See application file for complete search history.

(56) References Cited

U.S. PATENT DOCUMENTS

| | | | | |
|---|---|---|---|---|
| 5,574,538 | A | 11/1996 | Takahashi et al. | |
| 8,456,497 | B2 * | 6/2013 | Iguchi et al. | 347/179 |
| 2010/0315475 | A1 * | 12/2010 | Taki et al. | 347/179 |
| 2010/0321457 | A1 * | 12/2010 | Kawaguchi et al. | 347/179 |
| 2011/0221852 | A1 * | 9/2011 | Yahata et al. | 347/179 |
| 2012/0038732 | A1 * | 2/2012 | Iguchi et al. | 347/179 |

FOREIGN PATENT DOCUMENTS

| | | |
|---|---|---|
| JP | 2002-127479 | 5/2002 |
| JP | 2002-292912 | 10/2002 |
| JP | 2004-243563 | 9/2004 |
| JP | 2006-341986 | 12/2006 |

* cited by examiner

*Primary Examiner* — Kristal Feggins
(74) *Attorney, Agent, or Firm* — Patterson & Sheridan, L.L.P.

(57) ABSTRACT

In general, according to an embodiment, an erasing section erases the image on the sheet. A first conveying path conveys the sheet fed from a sheet feeding section and is provided with a reading section and a discharge section downstream of the reading section in a sheet conveying direction. A second conveying path is branched from the first conveying path downstream of the reading section in the sheet conveying direction and upstream of the discharge section in the sheet conveying direction. The second conveying path merges with the first conveying path upstream of the reading section in the sheet conveying direction and is provided with the erasing section. A sorting member, which is located at a branch point at which the second conveying path is branched from the first conveying path. A recording section is located on the first conveying path and records count information indicative of an erase count.

20 Claims, 5 Drawing Sheets

ERASING APPARATUS AND IMAGE ERASING METHOD

CROSS-REFERENCE TO RELATED APPLICATION

This application is based upon and claims the benefit of priority from U.S. provisional application 61/493,379, filed on Jun. 3, 2011; U.S. provisional application 61/493,386, filed on Jun. 3, 2011; U.S. provisional application 61/493,387, filed on Jun. 3, 2011; the entire contents of which are incorporated herein by reference.

FIELD

Embodiments described herein relate to a technique for recording an erase count on a sheet as a history.

BACKGROUND

Conventionally known are erasing apparatuses which are capable of erasing an image having been formed on a sheet in an erasable color material. The erasable color material employed can be, for example, heated and thereby decolorized. The erasing apparatus is capable, for example, of heating the sheet on which an image has been formed with the aforementioned erasable color material, thereby erasing the image. A number of times of repeated erasures on the same sheet may possibly cause the sheet to deteriorate. The erasing apparatus is thus required of a technique for recording the erase count on the sheet as a history.

Meanwhile, some erasing apparatuses are adapted to read the image before being erased, thereby restoring the image after the erasure of the image. Some other erasing apparatuses are designed to erase the image and then read the remaining image so as to determine whether the sheet is reusable on the basis of the level of the residual of the image. These erasing apparatuses are required to have a reading section disposed on both upstream and downstream stages of the erasing section in order to restore the image or determine the reusability of the sheet after the erasure of the image. This leads to an increase in costs.

Thus, there is a need to develop a technique for addressing these problems at the same time, that is, the technique for recording the erase count on the sheet as a history and achieving at low costs the restoration of the image as well as the determination of the reusability after the erasure of the image.

DETAILED DESCRIPTION

In general, according to an embodiment, an erasing apparatus includes a sheet feeding section, a reading section, an erasing section, a discharge section, a first conveying path, a second conveying path, and a recording section. The sheet feeding section feeds a sheet. The reading section reads an image on a sheet. The erasing section erases the image on the sheet. The discharge section receives a sheet discharged. The first conveying path conveys the sheet fed from the sheet feeding section and is provided with the reading section as well as the discharge section downstream of the reading section in a sheet conveying direction. The second conveying path is branched from the first conveying path downstream of the reading section in the sheet conveying direction and upstream of the discharge section in the sheet conveying direction. The second conveying path merges with the first conveying path upstream of the reading section in the sheet conveying direction and is provided with the erasing section. A sorting member, which is located at a branch point at which the second conveying path is branched from the first conveying path, sorts a sheet into either the first conveying path where the discharge section is available or the second conveying path. The recording section is located on the first conveying path and records count information indicative of an erase count. Now, the embodiments will be described with reference to the accompanying drawings.

[First Embodiment]

Figure 1:
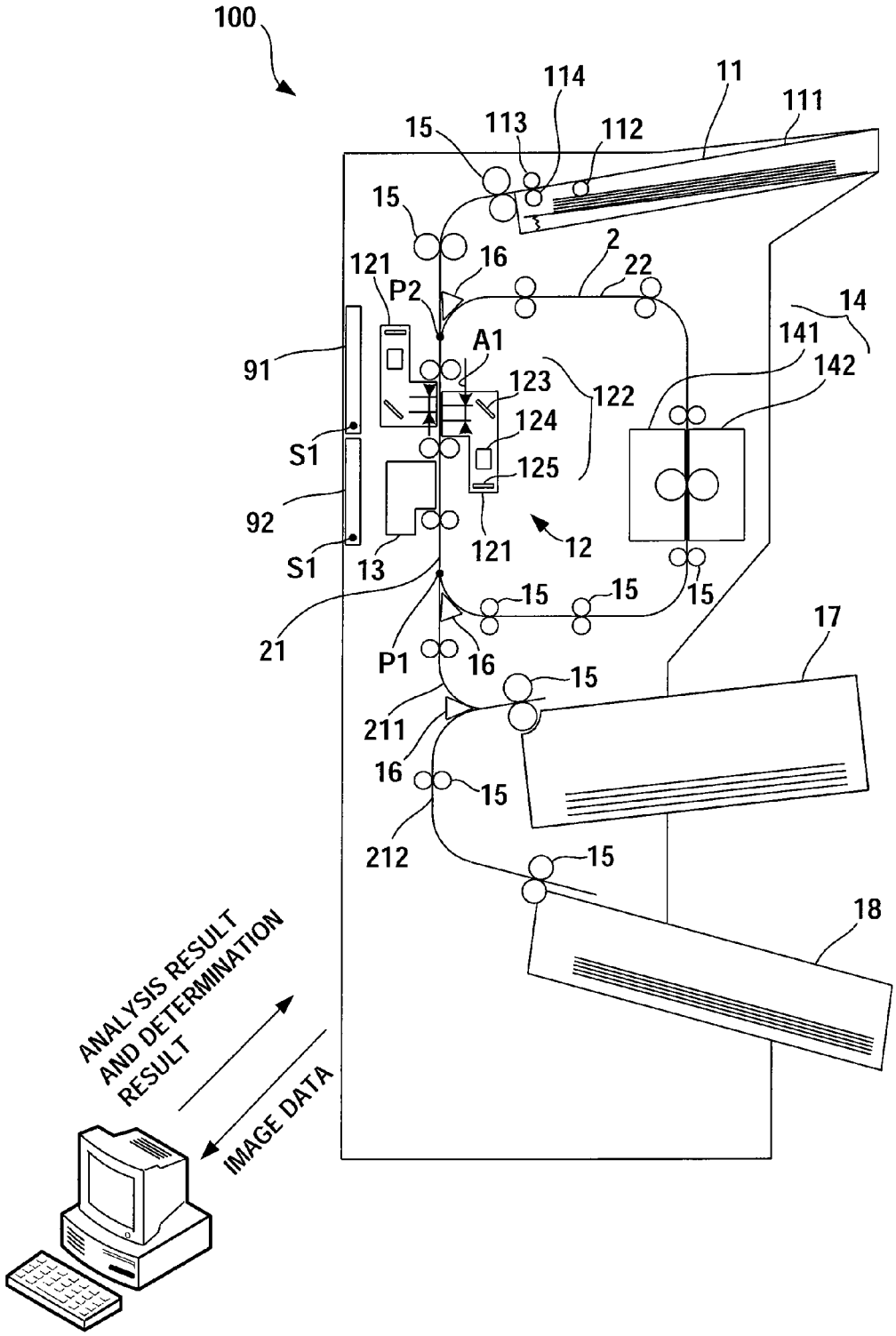
FIG. 1 is a view illustrating the configuration of an erasing apparatus.

FIG. 1 is a view illustrating the configuration of an erasing apparatus 100.

The erasing apparatus 100 performs "a decolorizing process (erasing process)" on a sheet on which an image has been formed with a "decolorable color material (erasable color material)" such as a decolorable toner and a decolorable ink to decolorize the image formed with the decolorable color material. Examples of such a decolorable color material may include color-forming compounds, color-developing agents, and decolorizing agents. Examples of such a color-forming compound may include leuco dyes. Examples of such a color-developing agent may include phenols. Examples of such a decolorizing agent may include compounds that are compatible with a color-forming compound when heated and have no affinity for a color-developing agent. The decolorable color material can produce colors by the interaction with a color-forming compound and a color-developing agent, and can be decolorized by heating at a decolorizing temperature or higher due to the blocking of the interaction with the color-forming compound and the color-developing agent.

The erasing apparatus 100 includes a sheet feeding section 11, a conveying path 2, a reading section 12, a recording section 13, an erasing section 14, a conveying roller 15, a flapper 16 (sorting section), a first discharge section 17, and a second discharge section 18. The erasing apparatus 100 communicates with an external device 200 such as a personal computer (PC) and employs the processing capability of the external device 200 in order to perform an erasing process.

The sheet feeding section 11 includes a sheet feeding tray 111, a pickup roller 112, a supply roller 113, and a separation roller 114. The sheet feeding tray 111 accommodates sheets on which images are formed with a decolorable color material. The sheets may vary in size and can be, for example, A4-R, A4, or LTR. The pickup roller 112 transfers the sheets in the sheet feeding tray 111 to the conveying path 2. When the pickup roller 112 transfers a plurality of sheets into the conveying path 2, the supply roller 113 and the separation roller 114 are used in a pair so as to separate one sheet from the plurality of sheets and transfer that sheet to the conveying path 2.

The conveying path 2 includes a first conveying path 21 and a second conveying path 22.

The first conveying path 21 conveys sheets fed from the sheet feeding section 11. The first conveying path 21 is provided with the reading section 12, the recording section 13, and the first and second discharge sections 17 and 18 in that order from upstream in the sheet conveying direction. Between the recording section 13 and the first discharge section 17 on the first conveying path 21, there is a branch point P1 at which the second conveying path 22 is branched. Upstream of the reading section 12 in the sheet conveying direction on the first conveying path 21, there is a merging point P2 at which the second conveying path 22 merges therewith. Downstream of the branch point P1 in the sheet conveying direction on the first conveying path 21, there are a first switchback conveying path 211 and a second switchback conveying path 212. The first discharge section 17 is located at the downstream end of the first switchback conveying path 211 in the sheet conveying direction. The upstream of the second switchback conveying path 212 in the sheet conveying direction is connected to the first switchback conveying path 211. The second discharge section 18 is located at the downstream end of the second switchback conveying path 212 in the sheet conveying direction. The second switchback conveying path 212 discharges, to the second discharge section 18, a sheet which has been switchback conveyed from the first switchback conveying path 211.

On the first conveying path 21, the second conveying path 22 is branched from the branch point 21 which is located at a position downstream of the recording section 13 in the sheet conveying direction and upstream of the first discharge section 17 in the sheet conveying direction. The second conveying path 22 merges with the first conveying path 21 at the merging point P2 upstream of the reading section 12 in the sheet conveying direction.

The second conveying path 22 is provided with the erasing section 14.

In the present embodiment, the maximum length of the sheet to be erased in the sheet conveying direction is the length (297 mm) of A4-R size (297 mm×210 mm) in the sheet conveying direction. The distance from the reading section 12 to the erasing section 14 and the distance from the erasing section 14 to the reading section 12 in the sheet conveying direction are longer than the length of the A4-R size in the sheet conveying direction.

The reading section 12 includes a first reading unit 121 (or first reading section) and a second reading unit 122 (or second reading section) which are provided on the first conveying path 21. Each of the reading units 121 and 122 causes an image pickup device 125 to receive, via a mirror 123 and a lens 124, the light which has traveled through a read area A1 opposed to a sheet into the reading units 121 and 122. The image pickup device 125 may be a contact image sensor (CIS), a charge coupled device (CCD) image sensor, or a complementary metal oxide semiconductor (CMOS). The first reading unit 121 reads one entire surface of the sheet.

The second reading unit 122 is opposed to the first reading unit 121 with the first conveying path 21 interposed therebetween. More specifically, the upstream of the second reading unit 122 in the sheet conveying direction is opposed to the first reading unit 121 with the first conveying path 21 interposed therebetween, while the downstream of the second reading unit 122 in the sheet conveying direction extends toward downstream in the sheet conveying direction relative to the first reading unit 121. The second reading unit 122 reads the other surface of the sheet.

The read areas A1 of the first and second reading units 121 and 122 are not aligned with each other in the sheet conveying direction. This allows the first and second reading units 121 and 122 to maintain a good read accuracy. The image data that is read by the first and second reading units 121 and 122 is stored in a memory unit 33 (FIG. 2) and used to determine whether or not an unerased image has been left on the sheet. On the other hand, the image data to be stored in the memory unit 33 can be retrieved after the image on the sheet has been erased, thereby utilizing the image data to restore the image which has been erased.

The recording section 13 is located on the first conveying path 21 on the same side as that of the first reading unit 121 and downstream of the first reading unit 121 in the sheet conveying direction so as to be at least partially opposed to a downstream portion of the second reading unit 122 in the sheet conveying direction with the first conveying path 21 interposed therebetween. As such, the recording section 13 is disposed so as to overlap with the second reading unit 122 with the first conveying path 21 interposed therebetween, thereby allowing for reducing the erasing apparatus 100 in size. The recording section 13 is located on the first conveying path 21 opposite to the second conveying path 22. That is, the recording section 13 is located near the cover of the erasing apparatus 100. The recording section 13 records on the sheet the count information which is indicative of an erase count.

The cover of the erasing apparatus 100 includes a reading section cover 91 and a recording section cover 92 which are opposed to the reading section 12 and the recording section 13, respectively. The reading section cover 91 and the recording section cover 92 can be pivoted outwardly from the erasing apparatus 100 about a rotation axis S that is located at a lower end portion. The user can open the reading section cover 91 and the recording section cover 92 to perform maintenance of the reading section 12 and the recording section 13.

The erasing section 14 includes two units, i.e., erase units 141 and 142 which are disposed on the second conveying path 22. The erasing section 14 causes the erase units 141 and 142 to be brought into contact with both the surfaces of the sheet and heat the surfaces, thereby erasing an image on the surfaces at a time.

The conveying roller 15 is available in multiples on the first and second conveying paths 21 and 22. Two of the conveying rollers 15 are paired to sandwich and convey a sheet.

The flapper 16 is located at the branch point P1 so as to sort the sheet passing through the recording section 13 into either the first conveying path 21, where the first and second discharge sections 17 and 18 are located, or the second conveying path 22. The flapper 16 is also located at the merging point P2 and the merging point of first and second switchback conveying paths 211 and 212.

The first discharge section 17 accommodates sheets discharged by the first switchback conveying path 211. The first discharge section 17 receives, by default, those discharged sheets which are reusable with no unerased image left thereon.

On the other hand, the second discharge section 18 accommodates sheets discharged by the second switchback conveying path 212. The second discharge section 18 receives, by default, discharged not-reusable sheets which have an unerased image left thereon or corner bents or the like.

To determine into which of the first and second discharge sections 17 and 18 reusable sheets and not reusable sheets are discharged, it is possible to operate a control input section 191 (FIG. 2) to provide appropriate control.

Figure 2:
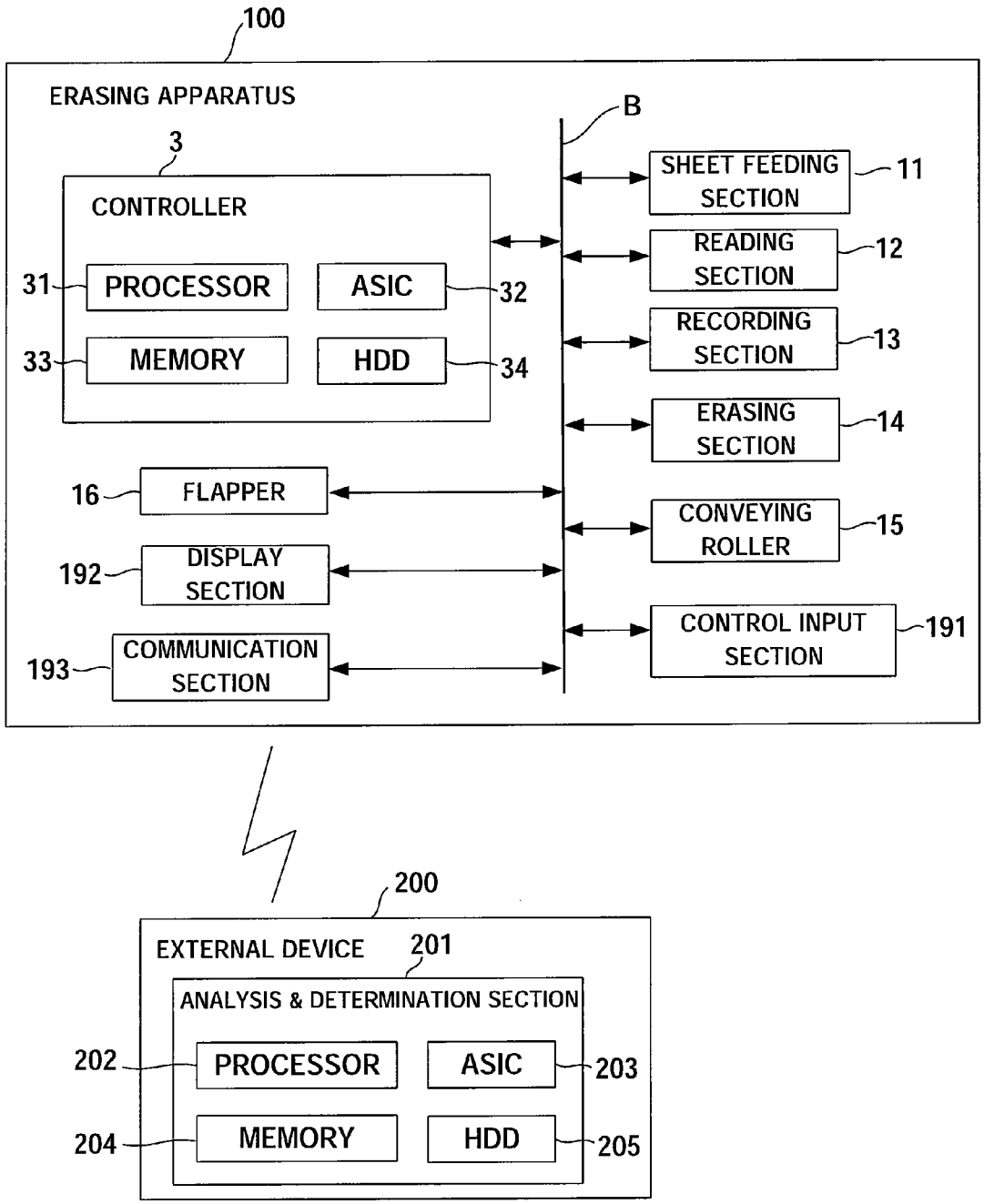
FIG. 2 is a block diagram illustrating the hardware configuration of the erasing apparatus.

FIG. 2 is a block diagram illustrating the hardware configuration of the erasing apparatus 100.

In addition to those components mentioned above, the erasing apparatus 100 includes a controller 3, the control input section 191, a display section 192, and a communication section 193 (a transmitter section and a receiver section). Each components are connected to each other via a bus B.

The controller 3 includes a processor 31, an ASIC (application specific integrated circuit) 32, the memory unit 33, and a hard disk drive (HDD) 34, and controls the entire erasing apparatus 100.

The control input section 191 includes, for example, a touch panel or control keys and receives user control input.

The display section 192, which is, for example, a touch panel, displays the setting information or the operation status of the erasing apparatus 100, log information, and notice to the user.

The operation input unit 18 or a display unit 19 is not limited to the one provided inside the body of the erasing device 100, but may be so configured that it can be operated from an operation input unit of an external device 200 connected to the erasing device 100 through a network. Alternatively, the operation input unit 18 or the display unit 19 may be configured independently of the erasing device 100 and to operate the erasing device 100 by wired or wireless communication. The operation input unit 18 or the display unit 19 according to this embodiment needs only to be able to provide instructions on processing to the erasing device 100 and to browse information of the erasing device 100.

The communication section 193 serves as an interface for connecting to external devices. The communication section 193 communicates by radio or by wire with the external device 200 on a network. The communication section 193 sends, to the external device 200, the image data which the reading section 12 provides by reading a sheet before and after the image thereon is erased. The communication section 193 also receives data transmitted from the external device 200.

Based on the image data, with the image not erased, which is received from the erasing apparatus 100, the external device 200 analyzes the erasure record information that is required to record the count information indicative of an erase count on the sheet, and then sends the analysis result to the erasing apparatus 100. Based on the image data, with the image erased, which is received from the erasing apparatus 100, the external device 200 determines whether or not the sheet is reusable, and then sends the determination result to the erasing apparatus 100. The external device 200 includes an analysis & determination section 201 which performs the analysis and the determination mentioned above. The analysis & determination section 201 is implemented with a processor 202, an ASIC 203, a memory unit 204, and a HDD 205.

In addition, the external device 200 may receive image data from a plurality of erasing apparatuses 100 connected via a network so as to function as a server performing processes relating to the erase count, determination of whether the sheet is reusable or not, and the like.

Figure 3:
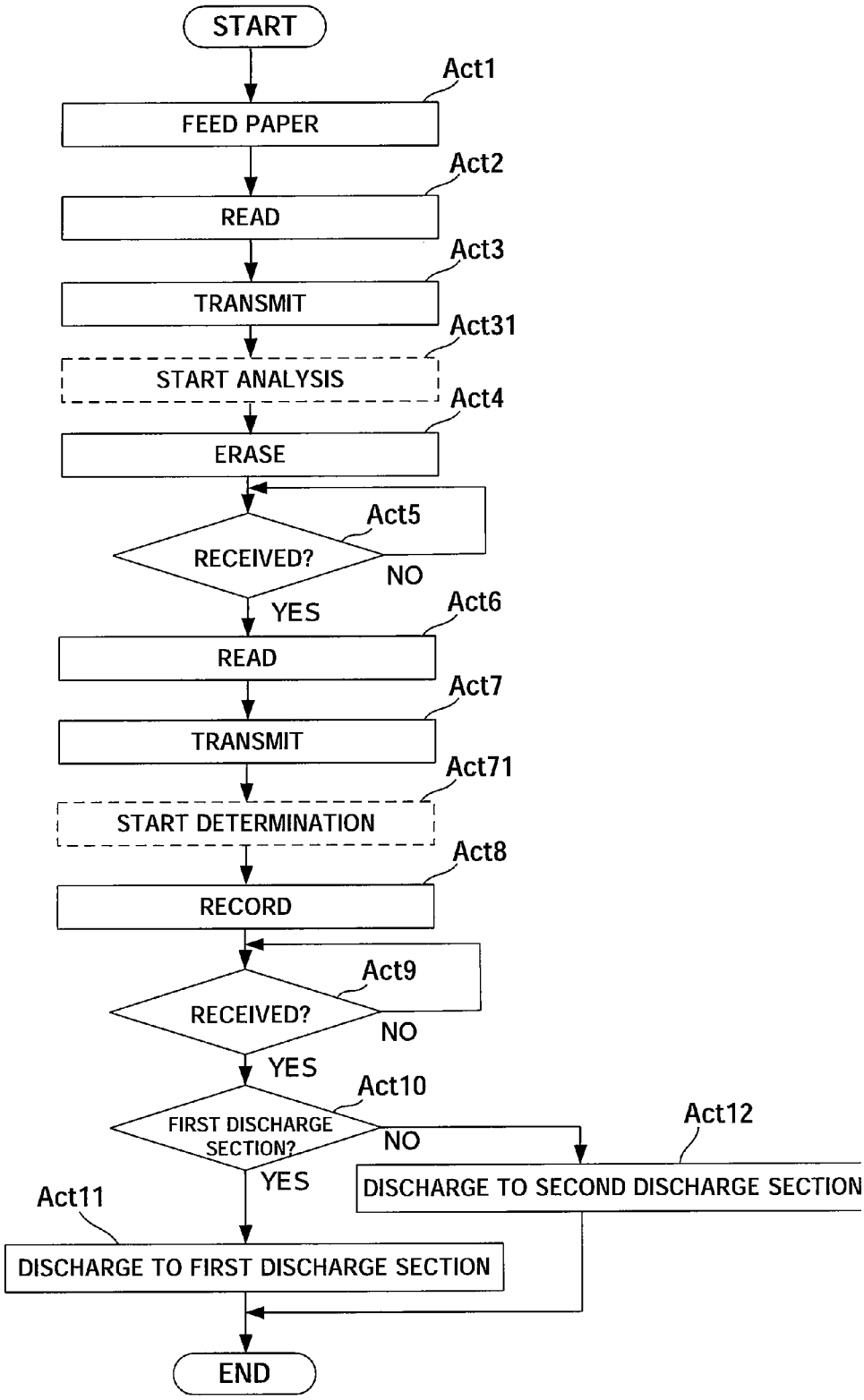
FIG. 3 is an explanatory flowchart showing the erasing process by the erasing apparatus.

Now, referring to the flowchart of FIG. 3, a description will be made to the erasing process by the erasing apparatus 100. The erasing process is implemented by the processor 31 reading the program which is non-temporarily stored in the memory unit 33.

The controller 3 causes the sheet feeding section 11 to feed a sheet to the conveying path 2 (Act 1). The controller 3 causes the sheet to be conveyed to the reading section 12 and then causes the reading section 12 to read an image on the surfaces of the sheet (Act 2).

Figure 4:
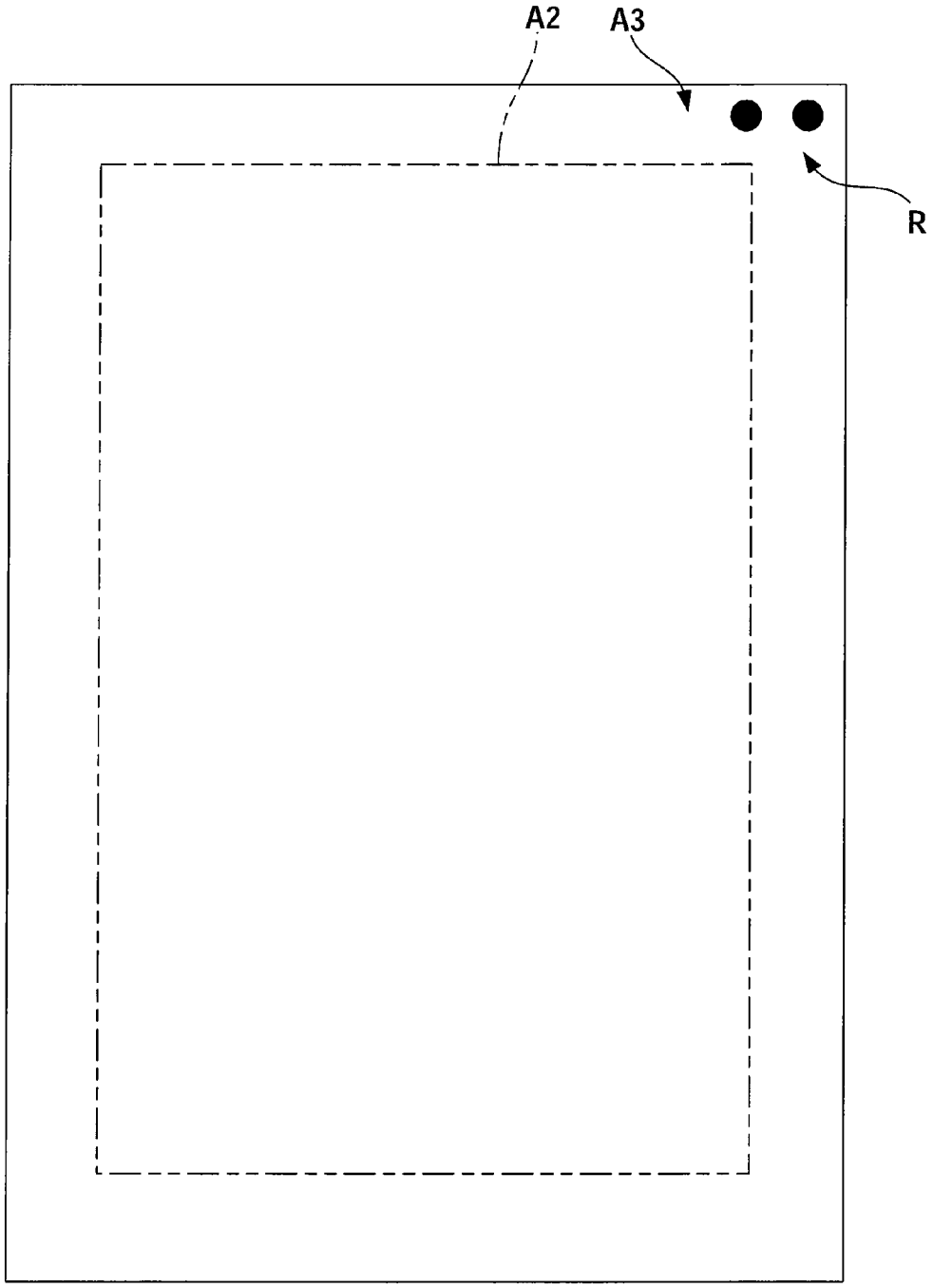
FIG. 4 is a view illustrating count information recorded on a sheet.

The controller 3 stores the resulting image data on the memory unit 33 and sends the image data to the external device 200 (Act 3). Based on the image data, the external device 200 starts to analyze the erasure record information that is required to record the count information indicative of an erase count on the sheet (Act 31). The erasure record information includes the erase count of the sheet until then and the position of the count information recorded on the sheet. In the present embodiment, as shown in FIG. 4, the count information R indicative of an erase count is recorded on the sheet in the form of dots. The number of dots indicates the erase count. The sheet of FIG. 4 is considered to have been erased twice. Here, the determination region A2 on which it is determined whether an unerased image has been left is the rectangular region A2 about the center of the sheet. The count information R is recorded in a frame-shaped region A3 outside the region A2 on which it is determined whether an unerased image has been left. Upon completion of the analysis of the erasure record information, the external device 200 sends the result of analysis to the erasing apparatus 100.

The controller 3 sorts a sheet, on which images have been read, into the second conveying path 22 at the branch point P1 and guides the sheet to the erasing section 14. Then, the controller 3 causes the erasing section 14 to erase the images on the surfaces of the sheet (Act 4).

Upon reception of the erasure record information from the external device 200 (Act 5: YES), the controller 3 causes the sheet to be conveyed back to the reading section 12 to read the surfaces of the sheet (Act 6). The controller 3 sends the image data to the external device 200. Based on the image data, the external device 200 starts to determine whether there is an unerased image left or a corner bent on at least either one surface of the sheet or there is no unerased image left or corner bent on the both surfaces (Act 71). When the determination is made on whether there is an unerased image left, the external device 200 sends the result of the determination to the erasing apparatus 100. Note that after the erasing process on the sheet, the controller 3 places the sheet on standby in front of the reading section 12 until the controller 3 receives the erasure record information from the external device 200 (Act 5: NO).

Based on the erasure record information received from the external device 200, the controller 3 records the count information R indicative of the erase count of the sheet on the sheet from which the image has been erased. In the present embodiment, it is assumed that the erasure record information received from the external device 200 indicates that the erase count of the sheet before the image thereon is erased is twice, and the position of the count information R on the sheet is at the upper right in FIG. 4. Based on the erasure record information, the controller 3 causes the recording section 13 to record the third point as the count information R on the left of the already recorded count information R in FIG. 4. This shows that the erase count of the sheet is three times. The recording section 13 forms the count information R (a point image) in a non-decolorable ink that will not be decolorized even when being heated (Act 8).

The controller 3 receives from the external device 200 the determination of whether an unerased image has been left on the sheet (Act 9: YES). If the received determination shows that the sheet is reusable (Act 10: YES), then the controller 3 causes the sheet to be discharged to the first discharge section 17 which is associated with this determination (Act 11). On the other hand, if the determination shows that the sheet is not reusable (Act 10: NO), then the controller 3 causes the sheet to be conveyed toward downstream of the first switchback conveying path 211 in the sheet conveying direction and then switchback conveyed to the second switchback conveying path 212. Then, the controller 3 causes the sheet to be discharged to the second discharge section 18 which is associated with the determination that the sheet is not reusable.

Note that as described above, it is also possible to set so that the sheet that has been determined reusable is discharged to the second discharge section 18 and the sheet that has been determined not reusable is discharged to the first discharge section 17.

(Second Embodiment)

Figure 5:
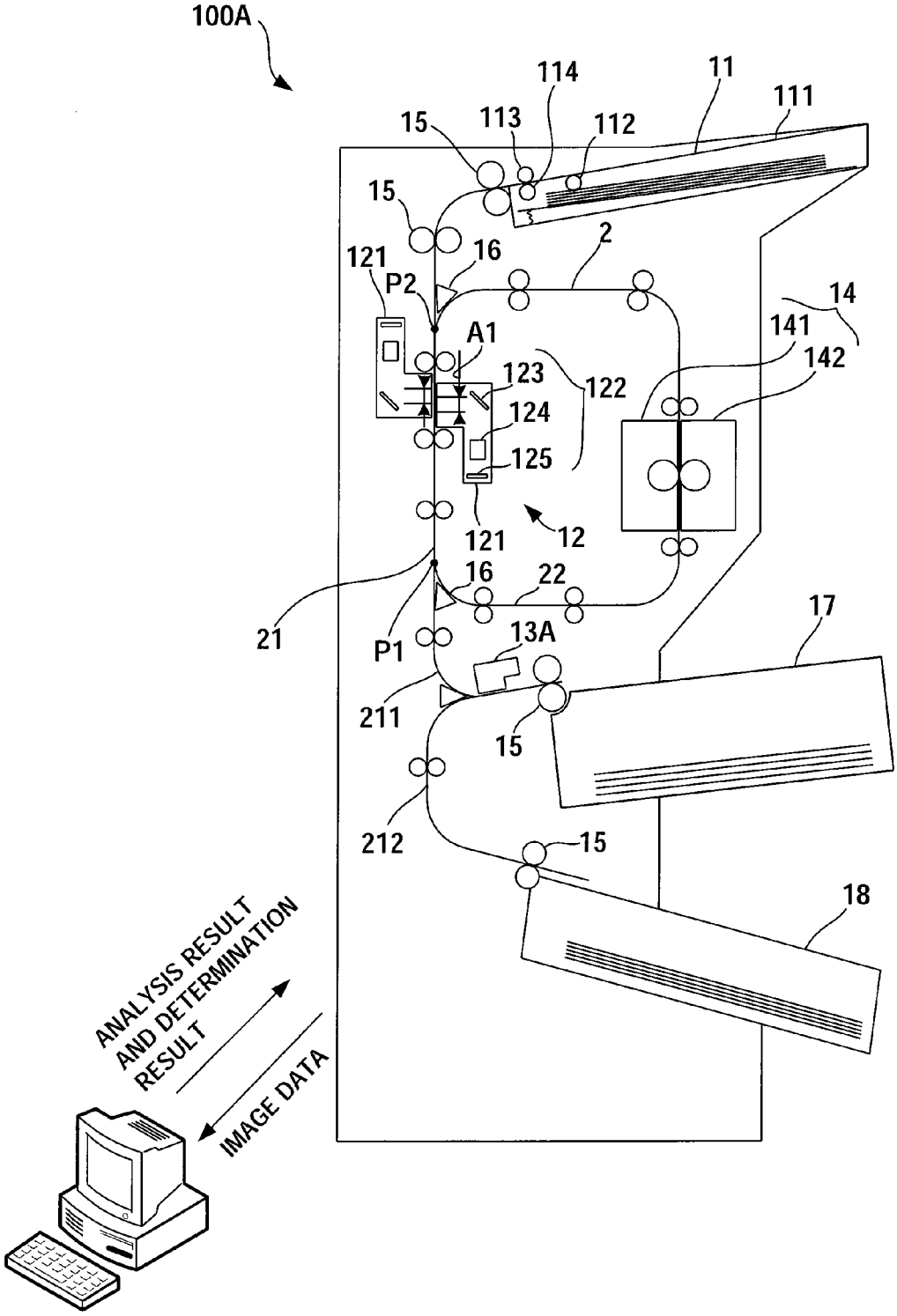
FIG. 5 is a view illustrating the configuration of an erasing apparatus according to a second embodiment.

FIG. 5 is a view illustrating the configuration of an erasing apparatus 100A.

In the present embodiment, a recording section 13A is interposed between the first switchback conveying path 211 located at a position downstream of the branch point P1 in a sheet conveying direction and the second conveying path 22 extending from the branch point P1. In the present embodiment, since the recording section 13A can form the count information R (point image) on the sheet from above, the count information R can be formed on the sheet in a preferred manner.

The recording section 13 may also form each time the count information indicative of the erase count on the sheet in a decolorable ink, for example, an image "Reuse for the second time."

In each of the embodiments described above, based on the image data, the external device 200 analyzes the erasure record information such as the position of the count information R formed on the sheet and determines whether an unerased image has been left. However, these analysis and determination may also be performed by the controller 3 of the erasing apparatus 100. In this case, the controller 3 conducts the analysis and determination and at the same time, serves as the transmitter section for transmitting the image data to the section where the analysis and determination are carried out and as the receiver section for receiving the results of the analysis and determination from that section.

In the above descriptions of the embodiments, the "decolorizing process (erasing process)" was described to mean that the color of an image is decolorized, but may include the meaning that an image is erased. In other words, the erasing apparatus described in any of the embodiments should not be limited to an apparatus that decolorizes an image by heating. Examples of such an erasing apparatus may include an apparatus that can decolorize an image on a sheet by irradiating it with light, an apparatus that can erase an image formed on a specific sheet, and an apparatus that can remove (erase) an image on a sheet. Namely, any apparatuses that are configured so as to make an image on a sheet invisible in order to reuse the sheet can be used.

In the above descriptions of the embodiments, the external device 200 can receive image data from erasing apparatuses 100 so as to perform processes relating to the erase count, determination of whether the sheet is reusable or not, and the like, but the present invention is not limited to this. For example, the controller 3 of any erasing apparatus 100 may perform processes relating to the erase count, determination of whether the sheet is reusable or not, and the like.

As for a storage medium, it may take any form so long as the medium can store a program and serves as a computer-readable storage medium. More specifically, the storage medium may include: an internal storage device such as ROM or RAM devices which are implemented in the computer; a transportable storage medium such as CD-ROMs, flexible discs, DVDs, magneto-optical discs, or IC cards; a database for storing computer programs; or other computers and the database thereof. The functions available by installation or download may be implemented in cooperation with the operating system (OS) or the like of the apparatus. The program may be an executable module which is dynamically created in part or in whole.

The order of the process steps in each of the embodiments described above may differ from that illustrated in each of the embodiments.

As described above, the techniques described in this specification can make it possible to record the erase count as a history on a sheet.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. An erasing apparatus comprising:

a sheet feeding section configured to feed a sheet;

a reading section configured to read an image on a sheet;

an erasing section configured to erase an image on a sheet;

a discharge section into which a sheet is discharged;

a first conveying path configured to convey a sheet fed from the sheet feeding section and to be provided with the reading section and with the discharge section downstream of the reading section in a sheet conveying direction;

a second conveying path branched from the first conveying path downstream of the reading section in the sheet conveying direction and upstream of the discharge section in the sheet conveying direction, the second conveying path merging with the first conveying path upstream of the reading section in the sheet conveying direction and provided with the erasing section;

a sorting member located at a branch point at which the second conveying path is branched from the first conveying path and configured to sort a sheet into either the first conveying path where the discharge section is available or the second conveying path; and a recording section located on the first conveying path and configured to record count information indicative of an erase count on a sheet.

2. The erasing apparatus according to claim 1, wherein the recording section is located on the first conveying path opposite to the second conveying path.

3. The erasing apparatus according to claim 1, wherein the reading section includes a first reading section configured to read one surface of a sheet and a second reading section configured to read the other surface of the sheet, an upstream portion of the second reading section in the sheet conveying direction being opposed to the first reading section with the first conveying path interposed therebetween and a downstream portion of the second reading section in the sheet conveying direction being extended toward downstream from the first reading section in the sheet conveying direction, and the recording section is located on the first conveying path on the same side as that of the first reading section and downstream of the first reading section in the sheet conveying direction, the recording section being at least partially opposed to a downstream portion of the second reading section in the sheet conveying direction with the first conveying path interposed therebetween.

4. The erasing apparatus according to claim 1, wherein the discharge section includes a first discharge section and a second discharge section, and the erasing apparatus further comprises a transmitter section configured to transmit image data to a recipient, the recipient being configured to analyze the count information recorded on a sheet on the basis of first image data on the sheet before being erased and to make a predetermined determination on the basis of second image data on the sheet after being erased, a receiver section configured to receive an analysis result and a determination result from the recipient, and a controller configured to perform: causing the reading section to read an image on a sheet in the first conveying path so as to acquire the first image data and thereafter causing the sheet to be conveyed to the second conveying path; causing the erasing section to erase the image on the sheet; subsequently causing the reading section to read an erased surface of the sheet so as to acquire the second image data; causing the sorting section to sort the sheet into the first conveying path at the branch point; causing the sheet to be discharged to one of the first discharge section and the second discharge section, the one being associated with the determination result received by the receiver section; and causing the recording section to record count information on the sheet, from which the image has been erased, on the basis of the analysis result received by the receiver section.

5. The erasing apparatus according to claim 1, wherein the sheet feeding section feeds a sheet on which an image has been formed with a toner which is decolorized by heating, and the erasing section heats the sheet to decolorize the image, thereby erasing the image.

6. The erasing apparatus according to claim 1, wherein the recording section records count information on a sheet with an ink which is not decolorized by heating.

7. The erasing apparatus according to claim 1, wherein the recording section is interposed between the first conveying path downstream of the branch point in the sheet conveying direction and the second conveying path extending from the branch point.

8. A method for erasing an image using an image erasing apparatus, the image erasing apparatus including: a sheet feeding section; a reading section; an erasing section; a discharge section into which a sheet is discharged; a first conveying path provided with the reading section and the discharge section downstream of the reading section in a sheet conveying direction; a second conveying path branched from a branch point in the first conveying path, the branch point being located at a position downstream of the reading section in the sheet conveying direction and upstream of the discharge section in the sheet conveying direction, the second conveying path configured to merge with the first conveying path upstream of the reading section in the sheet conveying direction and to be provided with the erasing section; and a sorting member located at the branch point, the method comprising:

causing the sheet feeding section to convey a sheet having an image formed thereon to the first conveying path or to convey the sheet to the second conveying path and thereafter to the first conveying path;

causing the reading section to read the image on the sheet in the first conveying path;

causing the sorting member to sort, at the branch point, the sheet in the first conveying path into the second conveying path;

causing the erasing section to erase the image on the sheet in the second conveying path;

causing the reading section to read the erased surface of the sheet having been conveyed from the second conveying path to the first conveying path;

causing the sorting member to sort, at the branch point, the sheet in the first conveying path into the first conveying path; and causing the erasing section to erase the image on the sheet and thereafter causing count information to be recorded on the sheet.

9. The image erasing method according to claim 8, wherein the count information is recorded on the sheet in the first conveying path from the first conveying path opposite to the second conveying path.

10. The image erasing method according to claim 8, wherein the reading section includes a first reading section configured to read one surface of a sheet and a second reading section configured to read the other surface of the sheet, an upstream portion of the second reading section in the sheet conveying direction being opposed to the first reading section with the first conveying path interposed therebetween and a downstream portion of the second reading section in the sheet conveying direction being extended toward downstream of the first reading section in the sheet conveying direction, and the count information is recorded on the sheet from a position on the first conveying path on the same side as that of the first reading section and downstream of the first reading section in the sheet conveying direction, the position being at least partially opposed to the downstream portion of the second reading section in the sheet conveying direction with the first conveying path interposed therebetween.

11. The image erasing method according to claim 8, wherein the discharge section includes a first discharge section and a second discharge section, and the method comprises transmitting image data to a recipient, the recipient being configured to analyze the count information recorded on a sheet on the basis of first image data on the sheet before being erased and to make a predetermined determination on the basis of second image data on the sheet after being erased, receiving an analysis result and a determination result from the recipient, causing the reading section to read an image on a sheet in the first conveying path so as to acquire the first image data and thereafter causing the sheet to be conveyed to the second conveying path, causing the erasing section to erase the image on the sheet, causing the reading section to read an erased surface of the sheet so as to acquire the second image data, causing the sorting section to sort the sheet into the first conveying path at the branch point, causing the sheet to be discharged to one of the first discharge section and the second discharge section, the one being associated with the determination result received, and causing count information to be recorded on the sheet, from which the image has been erased, on the basis of the analysis result received.

12. The image erasing method according to claim 8, wherein the sheet feeding section feeds a sheet on which an image has been formed with a toner which is decolorized by heating, and the erasing section heats the sheet to decolorize the image, thereby erasing the image.

13. The image erasing method according to claim 8, wherein the count information is recorded on the sheet with an ink which is not decolorized by heating.

14. The image erasing method according to claim 8, wherein the count information is recorded on the sheet from between the first conveying path downstream of the branch point in the sheet conveying direction and the second conveying path extending from the branch point.

15. A computer-readable storage medium configured to non-temporarily store an erase program executed by a computer to cause an image erasing apparatus to erase an image, the image erasing apparatus including: a sheet feeding section; a reading section; an erasing section; a discharge section into which a sheet is discharged; a first conveying path provided with the reading section and the discharge section downstream of the reading section in a sheet conveying direction; a second conveying path branched in the first conveying path from a branch point, the branch point being located at a position downstream of the reading section in the sheet conveying direction and upstream of the discharge section in the sheet conveying direction, and configured to merge with the first conveying path upstream of the reading section in the sheet conveying direction and to be provided with the erasing section; a sorting member located at the branch point; and a recording section located on the first conveying path and configured to record count information indicative of an erase count on a sheet; the erase program comprising:

causing the sheet feeding section to convey a sheet having an image formed thereon to the first conveying path or to convey the sheet to the second conveying path and thereafter to the first conveying path;

causing the reading section to read the image on the sheet in the first conveying path;

causing the sorting member to sort, at the branch point, the sheet in the first conveying path into the second conveying path;

causing the erasing section to erase the image on the sheet in the second conveying path;

causing the reading section to read the erased surface of the sheet having been conveyed from the second conveying path to the first conveying path;

causing the sorting member to sort, at the branch point, the sheet in the first conveying path into the first conveying path; and causing the erasing section to erase the image on the sheet and thereafter causing the recording section to record count information on the sheet.

16. The medium according to claim 15, wherein the recording section records the count information on the sheet in the first conveying path from the first conveying path opposite to the second conveying path.

17. The medium according to claim 15, wherein the reading section includes a first reading section configured to read one surface of a sheet and a second reading section configured to read the other surface of the sheet, an upstream portion of the second reading section in the sheet conveying direction being opposed to the first reading section with the first conveying path interposed therebetween and a downstream portion of the second reading section in the sheet conveying direction being extended toward downstream of the first reading section in the sheet conveying direction, and the recording section records the count information on the sheet, the recording section being located at a position on the first conveying path on the same side as that of the first reading section and downstream of the first reading section in the sheet conveying direction, the position being at least partially opposed to the downstream portion of the second reading section in the sheet conveying direction with the first conveying path interposed therebetween.

18. The medium according to claim 15, wherein the discharge section includes a first discharge section and a second discharge section, and the program comprises transmitting image data to a recipient, the recipient being configured to analyze the count information recorded on a sheet on the basis of first image data on the sheet before being erased and to make a predetermined determination on the basis of second image data on the sheet after being erased, receiving an analysis result and a determination result from the recipient, causing the reading section to read an image on a sheet in the first conveying path so as to acquire the first image data and thereafter causing the sheet to be conveyed to the second conveying path, causing the erasing section to erase the image on the sheet, causing the reading section to read an erased surface of the sheet so as to acquire the second image data, causing the sorting section to sort the sheet into the first conveying path at the branch point, causing the sheet to be discharged to one of the first discharge section and the second discharge section, the one being associated with the determination result received, and causing the recording section to record count information on the sheet, from which the image has been erased, on the basis of the analysis result received.

19. The medium according to claim 15, wherein the sheet feeding section feeds a sheet on which an image has been formed with a toner which is decolorized by heating, and the erasing section heats the sheet to decolorize the image, thereby erasing the image.

20. The medium according to claim 15, wherein the recording section records the count information on the sheet with an ink which is not decolorized by heating.

* * * * *